United States Patent [19]

Shiroyama

[11] Patent Number: 5,059,813

[45] Date of Patent: Oct. 22, 1991

[54] SOLENOID SWITCH FOR A COAXIAL ENGINE STARTER

[75] Inventor: Shigeru Shiroyama, Himeji City, Japan

[73] Assignee: Mitsubishi Denki Kabushiki Kaisha, Tokyo, Japan

[21] Appl. No.: 559,916

[22] Filed: Jul. 30, 1990

[30] Foreign Application Priority Data

Aug. 1, 1989 [JP] Japan ..... 1-200541

[51] Int. Cl.[5] ..... F02N 11/02

[52] U.S. Cl. ..... 290/48; 290/38 R; 335/278

[58] Field of Search ..... 290/38 R, 48; 335/278

[56] References Cited

U.S. PATENT DOCUMENTS 4,924,126 5/1990 Isozumi ..... 335/278

*Primary Examiner*—A. D. Pellinen
*Assistant Examiner*—Robert L. Hoover
*Attorney, Agent, or Firm*—Sughrue, Mion, Zinn, Macpeak and Seas

[57] ABSTRACT

A solenoid switch for a coaxial engine starter comprises within a cylindrical case 31 a solenoid coil 33 wound around a hollow bobbin 34. The case supports stationary contact assemblies 42, 43 each composed of an electrical conductor 44 including a stationary contact element 45 and an electrically insulating member 46 disposed around the conductor so that the stationary contact element is within a cylindrical space 36 of the bobbin. A movable contact 39 is mounted on a plunger 37 which is magnetically actuatable by the solenoid coil for separably engaging with the stationary contact elements. The outer surface 50 of a tubular wall 47 of the bobbin is oval in cross-section so that thicker-wall portions 47*a* are defined between the inner and the outer surfaces 49, 50. The thicker-wall portions have recesses 51 for partially receiving the insulating members, which are sufficiently thick to provide the necessary electrical insulation for the conductors 44, and a sufficient radial spacing is provided for accommodating through bolts 24 for securing the solenoid switch to the starter motor 1.

2 Claims, 3 Drawing Sheets

SOLENOID SWITCH FOR A COAXIAL ENGINE STARTER

BACKGROUND OF THE INVENTION

This invention relates to a solenoid switch for a coaxial engine starter and more particularly to a coil bobbin structure of a solenoid coil for actuating switch contacts of a solenoid switch.

FIGS. 1 and 2 illustrate one example of a conventional coaxial engine starter. The coaxial engine starter typically comprises a d.c. electric motor 1 having a hollow armature rotary shaft 2, a solenoid switch 3 disposed at the rear end of the d.c. motor 1 and having a plunger 27 with a plunger rod 3a on which a movable contact 28 is mounted, and a push-rod 4 supported from the plunger rod 3a of the solenoid switch 3 and inserted into the armature rotary shaft 2. The armature rotary shaft 2 has an output shaft 5 coaxially inserted therein from its front (right-hand end as viewed in FIG. 1) end so that the rear end of the output shaft 5 is in engagement with the front end of the push-rod 4. A pinion 21 is disposed at the front end of the output shaft 5. When solenoid switch 3 is energized, the plunger 27 is magnetically driven forward (toward the right as viewed in FIG. 1) and the pinion 21 on the output shaft 5 is pushed forward into engagement with an engine ring gear (not shown) through the plunger rod 3a and the push rod 4.

At the rear end of the armature rotary shaft 2a, there is mounted a commutator 6 around which electrical brushes 9 held by holders 8 secured to a mounting plate 7 are brought into slidable contact. Behind the commutator unit including the commutator 6, the brushes 9 and the holders 8, and at a front end of the solenoid switch 3, a substantially disc-shaped core plate 10 is disposed. The core plate 10 has formed therein a central bore 11 (FIG. 2) and a magnetic attraction, force generating portion 12 axially and circumferentially extending on one side of the plate 10 along the edge of the central bore 11. The core plate 10 also has integrally formed therein, on the side opposite to the attraction force generating portion 12, a cylindrical portion 13 axially extending from the edge of the central bore 11. The cylindrical portion 13 rotatably supports the rear end of the armature rotary shaft 2 through a sleeve bearing.

On the rear surface of the core plate 10 on which the attraction force generating portion 12 is provided, a pair of stationary contacts 14 and 15 are disposed so that they are brought into electrical engagement with the movable contact 28 when the plunger 27 is actuated. The stationary contact 14 has an integral connection portion 16 extending through a through hole 17 and connected to a connection plate 19 connected to a terminal bolt 18 on the front side of the core plate 10. The stationary contact 15 has an integral conductor portion (not shown) which is connected to the positive-side brush 9 as well as to the lead-in conductor of the excitation coil 20 of the solenoid switch 3. The stationary contacts 14 and 15, the conductor portions and the connection plate 19 are molded with a resin within the through hole 17 of the core plate 10.

The coaxial engine starter also comprises a planetary speed reduction gear 22 mounted at the front end of the armature rotary shaft 2 of the d.c. motor 1 for reducing the speed of the armature rotary shaft 2 and an overrunning clutch assembly 23 connected between the planetary speed reduction gear 22 and the front end of the output rotary shaft 5 for transmitting the speed-reduced output of the planetary speed reduction gear 22 and for preventing the d.c. motor 1 from being driven by the engine when the output rotary shaft 5 is rotated at a high speed by the engine.

In the conventional coaxial engine starter, the solenoid switch 3 is connected to the rear end of the d.c. motor 1 through a plurality of bolts 24, which extend through an annular space 3c defined between the tubular case 3b and the outer surface of the excitation coil 20 as best seen from FIG. 2, so that the outer diameter of the excitation coil 20 cannot be made larger than a certain limit. Therefore, in order to provide a necessary space for accommodating the winding of the excitation coil 20, the thickness of the cylindrical portion 25a of the coil bobbin 25 on which the excitation coil 20 is wound must be made thin. Also, the resinous holder member 26 molded around the stationary contacts 14 and 15 which are positioned at the end portion of the coil bobbin 25 has a very thin wall 26a between the coil bobbin cylinder 25a and the stationary contacts 14 and 15. This arrangement is disadvantageous in that the electrical insulation at the thin wall 26a is insufficient for a relatively large current flowing through the stationary contacts 14 and 15. Also, the formation of the thin wall 26a of the resinous holder member 26 is difficult.

SUMMARY OF THE INVENTION

Accordingly, an object of the present invention is to provide a solenoid switch for a coaxial engine starter free from the above discussed problems of the conventional design.

Another object of the present invention is to provide a solenoid switch for a coaxial engine starter which has a sufficiently insulated stationary contact while having a space sufficiently large for accommodating an excitation coil therein.

Still another object of the present invention is to provide a solenoid switch for a coaxial engine starter which has a sufficiently thick insulation between the stationary contact and the excitation coil bobbin while providing a space sufficiently large for accommodating an excitation coil therein.

A further object of the present invention is to provide a solenoid switch for a coaxial engine starter in which the resinous insulation members molded around the stationary contact conductors can be easily manufactured.

With the above objects in view, the solenoid switch for a coaxial engine starter of the present invention comprises a cylindrical case, a hollow coil bobbin concentrically disposed within the case and defining a cylindrical space, and a solenoid coil wound around the coil bobbin within the case. A stationary contact assembly which has an electrical conductor including a stationary contact element and an electrically insulting member disposed around the conductor is supported from the case and extends into the cylindrical space of the coil bobbin. A plunger is disposed within the cylindrical space of the coil bobbin and is axially slidable in response to the magnetic field generated by the solenoid coil, and a movable contact is mounted on the plunger for separably engaging with the stationary contact element. The coil bobbin has a tubular wall including a cylindrical inner surface along which the plunger slides and a non-cylindrical outer surface providing a thicker wall portion between the inner and the outer surfaces, and the coil bobbin has a recess formed in the inner surface in the thicker-wall portion for partially receiving therein the stationary contact assembly. The insulating member of the stationary contact assembly is partially received by the recess, and the insulating member of the stationary contact assembly has a thickness sufficient to provide a necessary electrical insulation of the conductor of the stationary contact assembly.

BRIEF DESCRIPTION OF THE DRAWINGS

The present invention will become more readily apparent from the following detailed description of the preferred embodiment of the present invention taken in conjunction with the accompanying drawings, in which.

PREFERRED EMBODIMENT OF THE INVENTION

Figure 1:
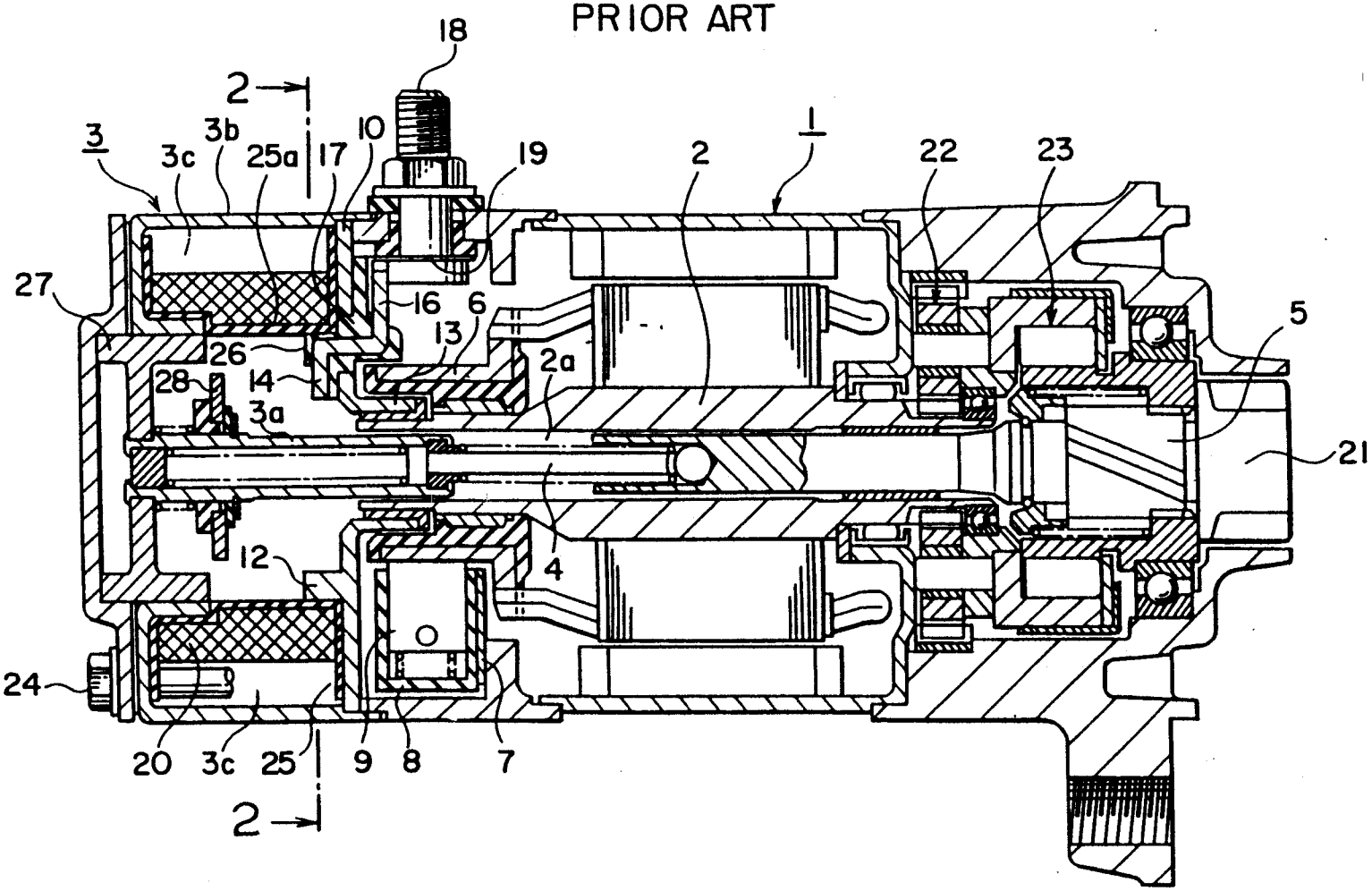
FIG. 1 PRIOR ART
FIG. 1 is a sectional side view of a conventional solenoid switch incorporated within an automotive coaxial engine starter.
Figure 2:
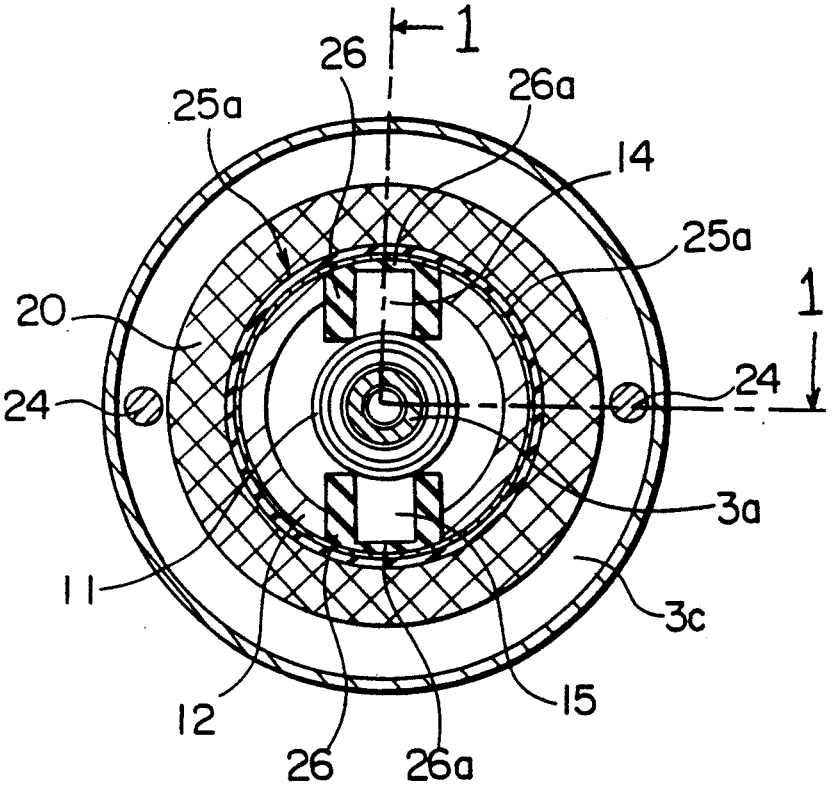
FIG. 2 is a sectional view taken along line 2—2 of FIG. 1.
Figure 4:
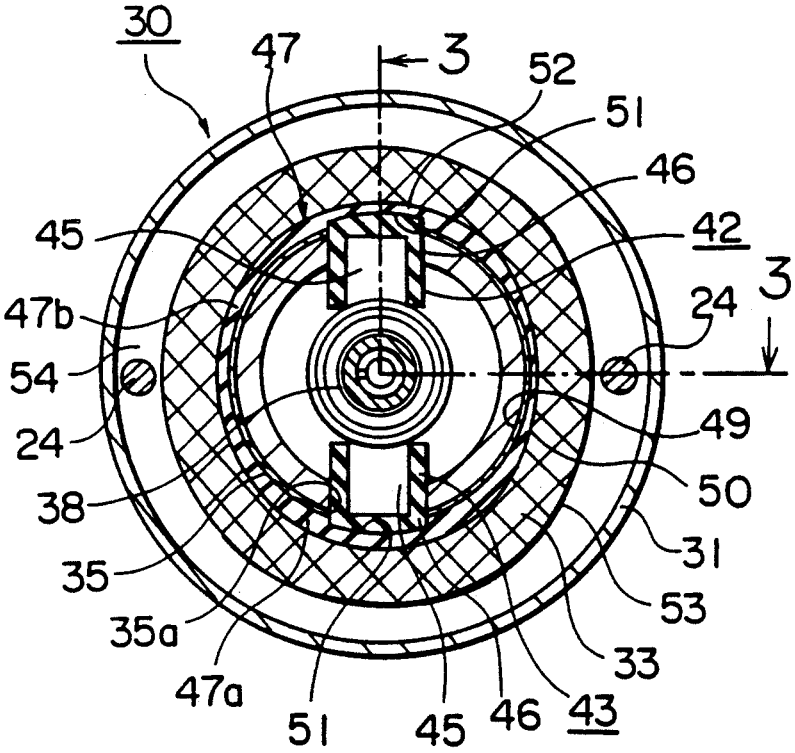
FIG. 4 is a sectional view taken along line 3—3 of FIG. 3.
Figure 3:
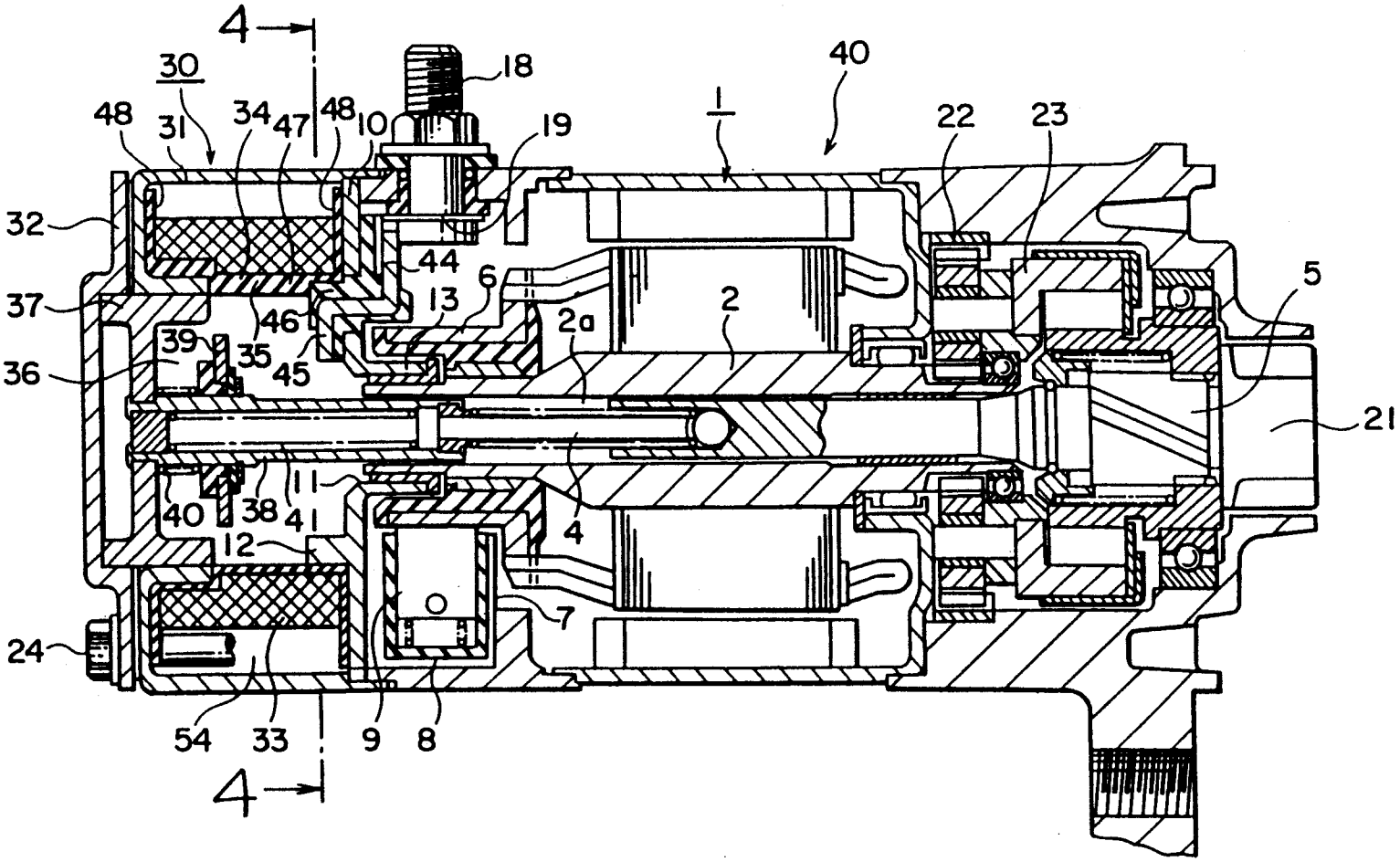
FIG. 3 is a sectional side view of a solenoid switch for a coaxial engine starter in accordance with the present invention.

FIGS. 3 and 4 illustrate one embodiment of a solenoid switch for a coaxial engine starter constructed in accordance with the present invention. The coaxial engine starter comprises a d.c. electric motor 1 having a cylindrical hollow armature rotary shaft 2, a solenoid switch 30 disposed at the rear (on the left as viewed in FIG. 3) end of the d.c. motor 1 and including a cylindrical plunger 37 with a plunger rod 38, and a push-rod 4 supported from the plunger rod 38 of the solenoid switch 30 and inserted into the armature rotary shaft 2. The armature rotary shaft 2 of the d.c. motor 1 has an output shaft 5 coaxially inserted therein from its front (on the right as viewed in FIG. 3) end so that its rear end is in engagement with the front end of the push-rod 4, and a pinion 21 disposed at the front end of the output shaft 21. When solenoid switch 30 is energized, the plunger 37 is magnetically driven forward (to the right in FIG. 3) and the pinion 21 on the output shaft 5 is pushed forward into engagement with an engine ring gear (not shown) through the plunger rod 38 and the push rod 4.

At the rear end of the armature rotary shaft 2a, there is mounted a commutator 6 around which electrical brushes 9 held by holders 8 secured to a mounting plate 7 are brought into slidable contact. Behind the commutator unit including the commutator 6, the brushes 9 and the holders 8, and at an end of the solenoid switch 30, a disc-shaped core plate 10 is disposed. The core plate 10 has formed therein a central bore 11 and an attraction force generating portion 12 axially and circumferentially extending on the rear side of the plate 10 along the edge of the central bore 11. The core plate 10 also has integrally formed therein, on the front side opposite to the attraction force generating portion 12, a cylindrical portion 13 axially extending along the edge of the central bore 11. The cylindrical portion 13 rotatably supports the rear end 2a of the armature rotary shaft 2 through a sleeve bearing.

The coaxial engine starter also comprises a planetary speed reduction gear 22 mounted at the front end of the armature rotary shaft 2 of the d.c. motor 1 for reducing the speed of the armature rotary shaft 2 and an overrunning clutch assembly 23 connected between the planetary speed reduction gear 22 and the front end of the output rotary shaft 5 for transmitting the speed-reduced output of the planetary speed reduction gear 22 and for preventing the d.c. motor 1 from being driven by the engine when the output rotary shaft 5 is rotated at a high speed by the engine.

On the rear (left side as viewed in FIG. 3) surface of the disc-shaped core plate 10 on which the attraction force generating portion 12 is provided, the solenoid switch 30 of the present invention is mounted. The solenoid switch 30 comprises a cylindrical case 31 having a front end attached to the d.c. motor 1 as well as to the disc-shaped core plate 10 and a rear end closed by an end bracket 32. The case 31 and the core plate 10 together constitute a magnetic path substantially surrounding a solenoid coil 33 wound around an electrically insulating coil bobbin 34. The hollow coil bobbin 34 is concentrically disposed within the case 31 and provides, together with an in-turned portion of the case 31, a substantially cylindrical surface covered with a cylindrical liner 35 which defines a cylindrical space 36.

Within the cylindrical space 36 defined within the solenoid coil 33, a plunger 37 is axially slidably disposed so that the plunger 37 can be magnetically driven forward in response to a magnetic field generated by the solenoid coil 33. The plunger 37 is generally in the shape of a disc surrounded by a relatively short cylindrical ring member. The plunger 37 has mounted thereon a plunger rod 38 projecting forward from the center of the plunger 37, and the plunger rod 38 has elastically mounted a movable contact 39 thereon through a compression spring 40. The front end of the plunger rod 38 is inserted into the rear end 2a of the hollow armature rotary shaft 2 of the d.c. motor 1 and operably coupled to the rear end of the push rod 4 therein through a compression spring 41 for pushing forward the output shaft 5.

The solenoid switch 30 also comprises a pair of stationary contact assemblies 42 and 43 (FIG. 4) firmly supported by the disc-shaped core plate 10 which is securely mounted to the outer casing of the d.c. motor 1 and to the case 31 of the solenoid switch 30. The stationary contact assemblies 42 and 43 each have a cranked electrical conductor 44 having formed on its one end a stationary contact element 45 and covered with an electrically insulating member 46. The contact elements 45 are exposed and positioned within the cylindrical space 36 defined within the solenoid coil 33 so that the movable contact 39 can engage and electrically connect them when the solenoid coil 33 is energized and the movable contact 39 is moved forward. The other end of the conductor 44 of the first contact assembly 42 is connected to the terminal bolt 18 of the starter, and the conductor 44 of the stationary contact assembly 43 is connected to the positive-side brush 9 as well as to the lead-in conductor of the solenoid coil 33 of the solenoid switch 30 although not illustrated.

According to the present invention, as seen from FIGS. 3 and 4, the coil bobbin 34 has a tubular wall 47 on which the solenoid coil 33 is wound and two flanges 48 extending from the axial ends of the cylindrical wall 47. The inner surface 49 of the cylindrical wall 47 is a cylindrical surface along which the liner 35 extends and the plunger 37 slides, and the outer surface 50 of the cylindrical wall 47 is a non-cylindrical surface which is preferably an oval in cross-section. Thus, the cylindrical wall 47 defined between the cylindrical inner surface 49 and the non-cylindrical outer surface 50 includes thicker wall portions 47*a* and thinner wall portions 47*b*. The cylindrical inner surface 49 has formed in the thicker wall portion of the cylindrical wall 47 a pair of recesses 51 for partially receiving therein the stationary contact assemblies 42 and 43. In other words, as best seen from FIG. 4, the insulating members 46 of the stationary contact assemblies 42 and 43 are partially received by the respective recesses 51. While the recesses 51 are formed in the tubular wall 47, the thickness of the tubular wall 47 at the position of the recesses 51 or the thickness of the bottom walls 52 of the recesses 51 is still large enough to provide a necessary mechanical strength as well as an electrical insulation of the conductors 44 of the stationary contact assemblies 42 and 43. It is to be noted that the liner 35 also has formed therein a pair of notches 35*a* corresponding to the recesses 51 for receiving the stationary contact assemblies 42 and 43 therein.

Since the solenoid coil 33 is wound on the oval outer surface 50 of the tubular wall 47 of the coil bobbin 34, the solenoid coil 33 also has an oval outer surface 53. Therefore, an annular space 54 defined between the cylindrical case 31 and the oval outer surface of the solenoid coil 33 does not have the same radial dimension along its circumference. Rather, the annular space 54 has a relatively small radial dimension at the positions corresponding to the stationary contact elements 45 and 46 and a radial dimension large enough to accommodate the through bolts 24 therein at the positions rotated by right angles from the position of the stationary contact elements 45 and 46. Therefore, the solenoid switch 30 can be securely connected to the rear end of the d.c. motor 1 through the bolts 24 as best seen from FIG. 3, without the need for decreasing the number of turns of solenoid coil 33.

As has been described, according to the solenoid switch for a coaxial engine starter of the present invention, the coil bobbin has a tubular wall including a cylindrical inner surface along which the plunger slides and a non-cylindrical outer surface providing a thicker wall portion between the inner and the outer surfaces, and the coil bobbin having a recess formed in the inner surface in the thickerwall portion for partially receiving therein the stationary contact assembly. The insulating member of the stationary contact assembly is partially received by the recess, and the insulating member of the stationary contact assembly has a thickness sufficient to provide a necessary electrical insulation of the conductor of the stationary contact assembly.

Accordingly, a sufficiently insulated stationary contact can be provided while maintaining a space sufficiently large for accommodating an excitation coil therein. Also, a solenoid switch for a coaxial engine starter which has a sufficiently thick insulation between the stationary contact and the excitation coil bobbin, while maintaining a space sufficiently large for accommodating an excitation coil therein can be provided. Since the insulation around the stationary contact is sufficient, the stationary contact conductors are allowed to carry a large current. Further, the manufacture of the molded insulating member provided around the conductor of the present invention is much easier than that of the conventional design.

What is claimed is:

1. A solenoid switch for a coaxial engine starter, comprising:

a cylindrical case (31);

a hollow coil bobbin (34) concentrically disposed within said case and defining a cylindrical space (36);

a solenoid coil (33) wound around said coil bobbin within said case;

a pair of diametrically opposed stationary contact assemblies (42, 43) having respective electrical conductors (44) including stationary contact elements (45) and electrically insulating members (46) individually disposed around said conductors, said stationary contact assemblies being supported from said case, and said stationary contact elements extending into said cylindrical space of said coil bobbin;

a plunger (37) disposed within said cylindrical space of said coil bobbin and axially slidable in response to a magnetic field generated by said solenoid coil;

a movable contact (39) mounted on said plunger for separably engaging with said stationary contact elements;

said coil bobbin having a tubular wall (47) defining a cylindrical inner surface (49) along which said plunger slides and an oval outer surface (50) such that thickened wall portions (47*a*) are formed between said inner and said outer surfaces at opposite ends of a major axis of said oval, and thinner wall portions (47*b*) are formed at opposite ends of a minor axis of said oval;

said coil bobbin having recesses (51) formed in said inner surface in said thickened wall portions for partially receiving therein said insulating members of said stationary contact assemblies; and said insulating members of said stationary contact assemblies having a thickness sufficient to provide a necessary electrical insulation of said conductors of said stationary contact assemblies; and a pair of elongated through bolts (24) individually extending alongside said thinner wall portions for assembling the solenoid switch to a motor of said engine starter.

2. A solenoid switch for a coaxial engine starter as claimed in claim 1, further comprising a disc-shaped iron core (10) secured to said case for supporting said stationary contact assembly.

* * * * *